US005228417A

United States Patent [19]

Hara

[11] Patent Number: 5,228,417

[45] Date of Patent: Jul. 20, 1993

[54] VALVE TIMING CONTROL SYSTEM OF INTERNAL COMBUSTION ENGINE

[75] Inventor: Seinosuke Hara, Kanagawa, Japan

[73] Assignee: Atsugi Unisia Corp., Tokyo, Japan

[21] Appl. No.: 875,263

[22] Filed: Apr. 28, 1992

[30] Foreign Application Priority Data

Apr. 30, 1991 [JP] Japan ..... P3-98609

[51] Int. Cl.[5] ..... F01L 1/34

[52] U.S. Cl. ..... 123/90.17; 123/90.31; 464/2; 74/568 R

[58] Field of Search ..... 123/90.12, 90.13, 90.15, 123/90.17, 90.31; 74/568 R, 567; 464/1, 2, 160

[56] References Cited

U.S. PATENT DOCUMENTS

| | | | |
|---|---|---|---|
| 4,231,330 | 11/1980 | Garcea | 123/90.15 |
| 5,117,785 | 6/1992 | Suga et al. | 123/90.17 |
| 5,129,370 | 7/1992 | Suga et al. | 123/90.17 |

FOREIGN PATENT DOCUMENTS

| | | | |
|---|---|---|---|
| 309704 | 12/1988 | Japan | 123/90.17 |
| 249310 | 11/1991 | Japan | 123/90.17 |

*Primary Examiner*—E. Rollins Cross
*Assistant Examiner*—Weilun Lo
*Attorney, Agent, or Firm*—Ronald P. Kananen

[57] ABSTRACT

A valve timing control system includes of a cylindrical sprocket driven through a timing chain by a crankshaft of the engine. An arm is fixed to one end section of the camshaft and located inside the sprocket in a manner to extend generally diametrically. First and second plungers are slidably disposed respectively in first and second cylindrical bores formed in the sprocket. A hydraulic pressure chamber is defined between the bottom portion of each plunger and the bottom wall of the cylindrical bore so as to be supplied with a hydraulic pressure from a hydraulic pressure source. Each plunger is projectable toward the arm upon supply of the hydraulic pressure to the corresponding hydraulic pressure chamber thereby to cause the arm to rotate relative to the sprocket. Projections of the first and second plungers induce the rotational movements of the arm in opposite directions relative to the sprocket, respectively. The rotational movements of the arm cause the camshaft to undergo relative rotation which advances or retards the valve timing of the intake and/or exhaust valves.

7 Claims, 3 Drawing Sheets

VALVE TIMING CONTROL SYSTEM OF INTERNAL COMBUSTION ENGINE

BACKGROUND OF THE INVENTION

1. Field of the Invention

This invention relates to improvements in a valve timing control system for variably controlling the opening and closing timings of intake and/or exhaust valves of an internal combustion engine in accordance with an engine operating condition, more particularly to a device for causing relative rotation between a camshaft to a sprocket which drives the camshaft.

2. Description of the Prior Art

A variety of valve timing control systems of the above-mentioned type have been proposed and put into practical use. Typical one of them is disclosed in the U.S. Pat. No. 4,231,330 and arranged as set forth below. The valve timing control system is arranged to control a camshaft for operating intake and/or exhaust valves of an internal combustion engine. The camshaft is formed at its front end section with an external thread. A sleeve is disposed around the front end section of the camshaft in a manner that its internal thread is engaged with the external thread of the camshaft front end section. A driven sprocket is disposed and supported around the sleeve and the front end section of the camshaft and provided at its outer periphery with teeth to which a rotational force is transmitted through a timing chain from a crankshaft of the engine. The driven sprocket is formed at its inner periphery with an internal thread. Additionally, a cylindrical gear is threadingly disposed between the internal thread of the driven sprocket and the external thread of the camshaft front end section. At least one of the internal and external threads of the cylindrical gear is helical. This cylindrical gear is moved in the axial direction of the camshaft in accordance with an engine operating condition, under the pressure in a hydraulic circuit and the biasing force of a spring, so that the camshaft rotates relative to the driven spocket.

However, in the above-discussed conventional valve timing control system, relative rotation between the driven sprocket and the camshaft is induced using the helical gear which is formed an at least one of the inner or outer peripheral surfaces of the cylindrical gear. This helical gear requires high precision machining to ensure good engagement with the internal thread of the driven sprocket the external thread of the camshaft. Thus, production or (machining) of the helical gear becomes troublesome and difficult, thereby lowering the production efficiency and raising a production cost for the valve timing control system.

SUMMARY OF THE INVENTION

An object of the present invention is to provide an improved valve timing control system of an internal combustion engine, which can overcome the drawbacks encountered in conventional valve timing control systems.

Another object of the present invention is to provide an improved valve timing control system of an internal combustion engine, which can be efficiently produced at a low production cost.

A further object of the present invention is to provide an improved valve timing control system of an internal combustion engine, in which the relative rotational phase of a camshaft to a driven sprocket can be changed in accordance with an engine operating condition without using a helical gear which is difficult to manufacture.

An internal combustion engine valve timing control system according to the present invention features a generally cylindrical rotatable member movably connected to an end section of a camshaft. The rotatable member is drivably connected with a crankshaft of the engine. An arm is fixedly connected to the end section of the camshaft and extends generally diametrically with respect to the rotatable member. First and second plungers are slidably movably disposed in, and extend axially along the rotatable member. Each of the first and second plungers defines a hydraulic pressure chamber and is projectable toward the arm upon supply of a hydraulic pressure to the hydraulic pressure chamber. Each of the first and second plungers has a thrusting portion. The thrusting portion has an inclined surface which is adapted to cause said arm to rotate relative to said plunger upon projection of the plunger. The hydraulic pressure is supplied to the hydraulic pressure chamber through a check valve. Additionally, a change-over mechanism is provided to switch the supply of the hydraulic pressure to the pressure chambers of the first and second plungers in accordance with engine operating conditions.

Accordingly, during low engine load operating condition, the hydraulic pressure is released from hydraulic pressure chamber of the first plunger, while the hydraulic pressure is supplied through the check valve to the hydraulic pressure chamber of the second plunger, under the action of the change-over michanism. Accordingly, the first plunger is maintained at its withdrawal position, while the second plunger advances toward the arm. The thrusting portion of the second plunger urges the arm in a negative direction which is opposite to the rotational direction of the rotatable member. This induce the camshaft to undergo maximum rotational movement in the positive direction relative to the rotatable member and is maintained in this position to retard, for example, the closing timing of each intake valve of the engine.

When the engine operation shifts to a high load condition, the change-over mechanism changes over the hydraulic pressure supply to the hydraulic pressure chambers of the first and second plungers, so that the hydraulic pressure is released from the hydraulic pressure chamber of the second plunger released, while the hydraulic pressure is supplied through the check valve to the hydraulic pressure chamber of the first plunger. Accordingly, the second plunger is maintained at its withdrawal position, while the first plunger advances toward the arm. Consequently, the thrusting portion of the first plunger urges the arm in the same rotational direction the rotatable member is rotating. As a result, the camshaft undergoes a maximum amount of rotational movement in a positive direction relative to the rotatable member and is maintained in this position to advance, for example, the closing timing of the intake valve.

Additionally, by virtue of the change-over mechanism, the hydraulic pressure is smoothly supplied to each hydraulic pressure chamber when a torque change is generated during rotation of the camshaft, i.e., when the thrusting portion of each plunger separates from the arm. By virtue of the check valve, the hydraulic pressure supplied to the hydraulic pressure chamber is prevented from undergoing a reverse flow. As a result, a rotation-directional change relative to the rotatable member can be smoothly carried our with a high response while securely maintaining the camshaft at the maximum relative rotational position.

DETAILED DESCRIPTION OF THE INVENTION

Figure 1:
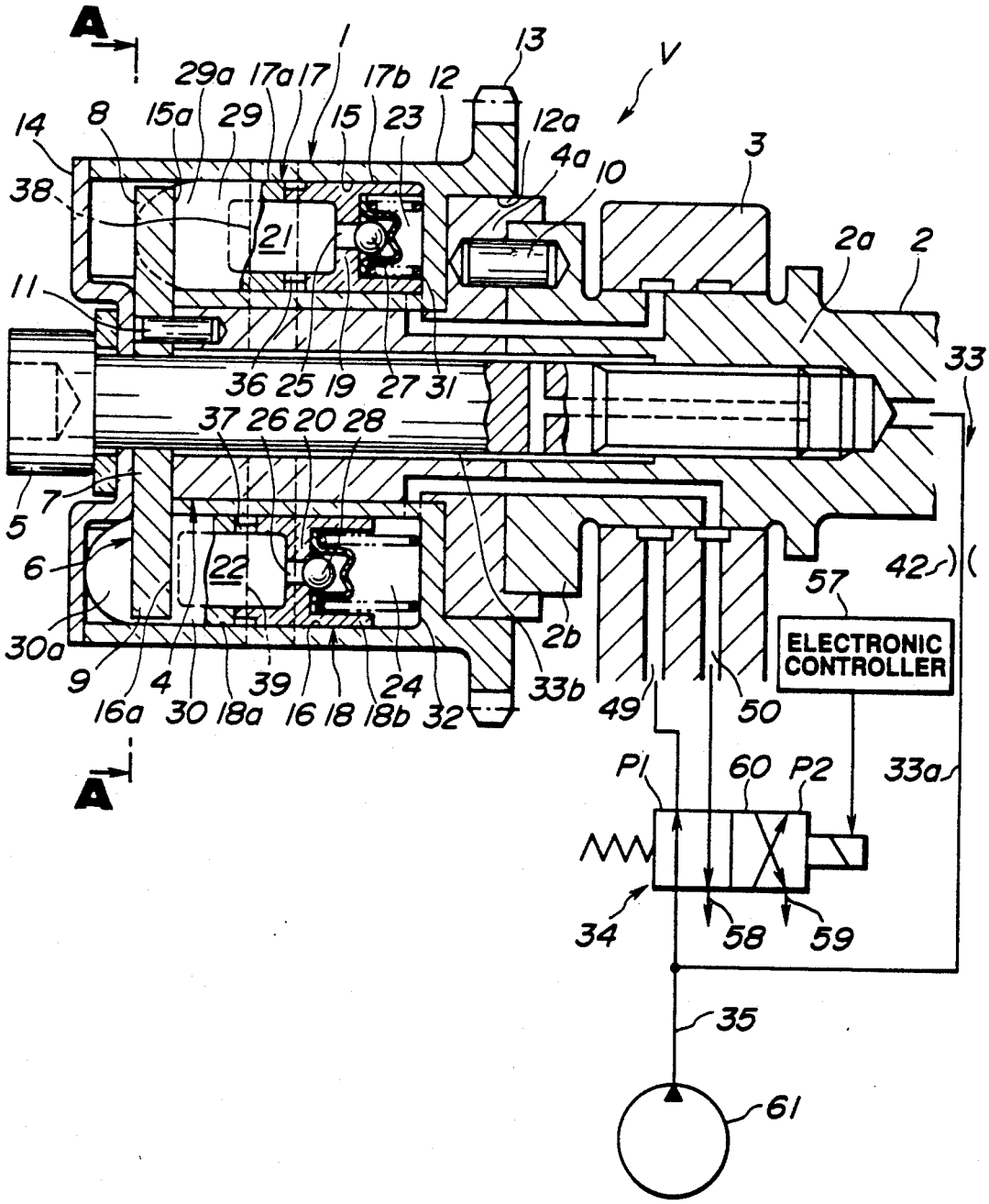
FIG. 1 is a vertical cross-sectional view of an embodiment of a valve timing control system for an internal combustion engine, in accordance with the present invention.

Referring now to FIGS. 1 to 4 of the drawings, an embodiment of a valve timing control system according to the present invention is illustrated by the reference character V. The valve timing control system V in this embodiment is arranged to control the operation of a camshaft 2 for intake valves of a gasoline-fueled double overhead camshaft automotive internal combustion engine (not shown). The camshaft 2 is rotatably supported by a camshaft bearing 3 formed at the upper section of the engine and has a plurality of cam lobes (not shown) for operating intake valves (not shown) of the engine.

The valve timing control system V includes a driven sprocket 1 which is disposed at one (front) end section 2*a* of the camshaft 2 and driven through a timing chain (not shown) by a driving sprocket (not shown) of a crankshaft (not shown) of the engine. A generally cylindrical sleeve 4 is attached to the tip end of the end section 2*a* of the camshaft 2 and fixed in position by means of an installation bolt 5 in such a manner as to be coaxial with the camshaft 2. The installation bolt 5 is screwed into the end section 2*a* of the camshaft 2 and is coaxial with the camshaft 2. The sleeve 4 is integrally formed with a large diameter flange section 4*a* which fits over a smaller diameter flange section 2*b* integrally formed at the end section 2*a* of the camshaft 2.

Figure 2:
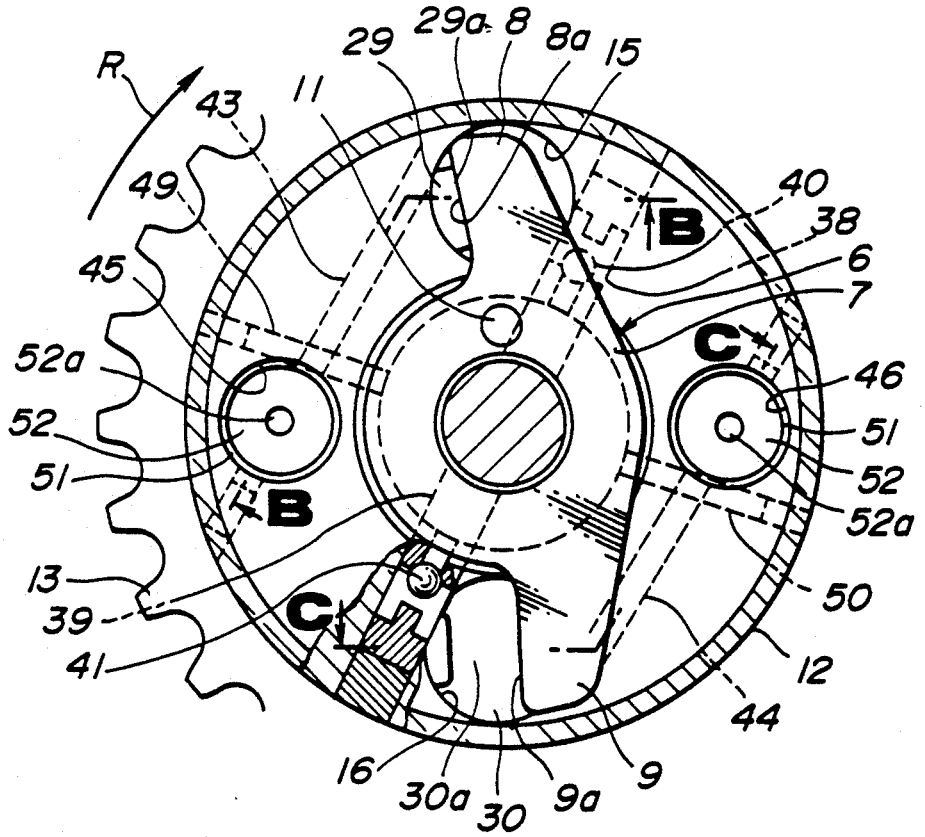
FIG. 2 is a cross-sectional view taken in the direction of arrows substantially along the line A—A of FIG. 1.
Figure 3:
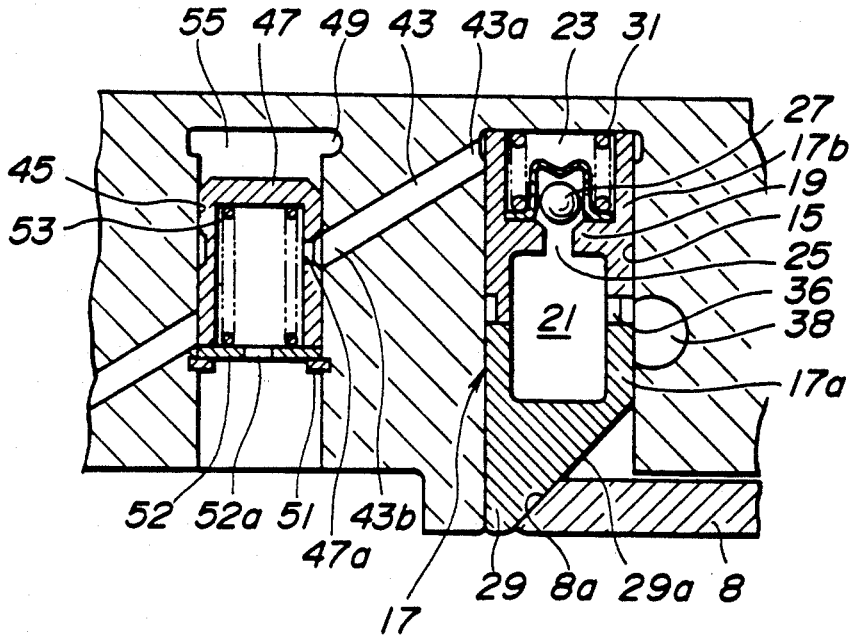
FIG. 3 is a cross-sectional view taken in the direction of arrows substantially along the line B—B of FIG. 2.
Figure 4:
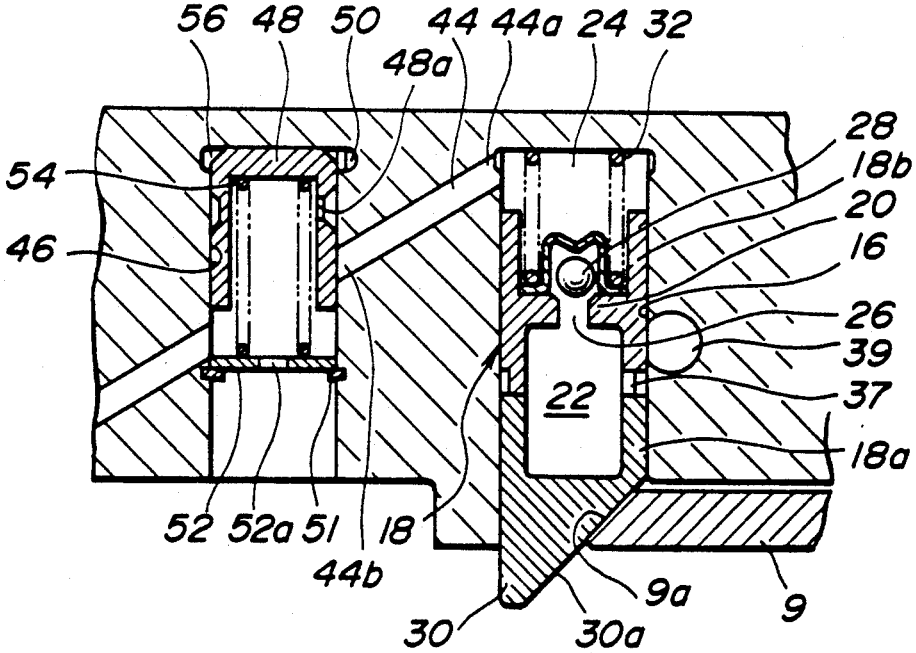
FIG. 4 is a cross-sectional view taken in the direction of arrows substantially along the line C—C of FIG. 2.

An arm 6 is attached at the tip end of the sleeve 4 and fixed in position together with the sleeve 4 by screwing and tightening the installation bolt 5. As clearly shown in FIGS. 2, 3 and 4, the arm 6 extends generally in the diametrical direction of the camshaft 2 and includes a generally annular base section 7 through which the arm 6 is fixed to the sleeve 4. The base section 7 is integrally formed with a pair of arm sections 8, 9 which extend generally radially outwardly and are located generally opposite to each other with respect to a plane passing through the extension of the axis of the camshaft 2. The arm sections 8, 9 are respectively formed with side edge portions 8*a*, 9*a* which extend generally radially outwardly are tapered like edges as shown in FIGS. 3 and 4. The side end portions 8*a*, 9*a* are formed on the same side of the respective arm sections 8, 9. The reference numeral 10 designates a large diameter pin which extends parallel with the axis of the camshaft 2 and is disposed both in the flange sections 2*b*, 4*a* for the locationing purpose for the sleeve 4. The reference numeral 11 designates a small pin which is inserted through the base section 7 of the arm 6 and tip end section of the sleeve 4 for the locationing purpose for the arm 6.

The driven sprocket 1 includes a generally cylindrical sprocket main body 12 which is formed at its rear end section and at its outer periphery with an annular gear section 13 whose gears project radially outwardly. An annular front cover 14 is fixed together with the arm 6 and the like by means of the installation bolt 5. The sprocket main body 12 is formed at its rear end with an annular groove 12*a* in which the large diameter flange section 4*a* of the sleeve 4 is slidably received. Accordingly, the sprocket main body 12 is rotatably supported on the sleeve large diameter flange section 4*a*. The fitting groove 12*a* is coaxial with the axis of the camshaft 2. The sprocket main body 12 is further formed with a pair of cylindrical bores 15, 16 each extends parallel with the axis of the camshaft 2. Each of the cylindrical bores 15, 16 is closed at its rear end and with a bottom wall (no numeral) integral with the sprocket main body 12. The cylindrical bores 15, 16 are respectively located generally corresponding to the arm sections 8, 9 of the arm 6 as shown in FIG. 2.

The front (left in FIG. 1) side openings 15*a*, 16*a* of the cylindrical bores 15, 16 face and abut on the arm sections 8, 9 of the arm 6, respectively. First and second plungers 17, 18 are slidably movably disposed in the cylindrical bores 15, 16, respectively. Each of the plungers 17, 18 is divided into front and rear parts 17*a*, 17*b*; 18*a*, 18*b*, as shown in FIGS. 1, 3 and 4. Each of the rear plunger parts 17*b*, 18*b* is formed with a partition wall 19, 20 located at the intermediate portion in its axial direction. Hydraulic fluid reservoir chambers 21, 22 are formed between the inner wall of the front parts 17*a*, 18*a* and the partition walls 19, 20 of the rear parts 17*b*, 18*b*. Hydraulic fluid pressure chambers 23, 24 are defined between the partition walls 19, 20 and the bottom wall forming part of the sprocket main body 12. The pressure chambers 21, 22 are located opposite to the reservoir chambers 21, 22 with respect to the partition walls 19, 20. The reservoir chambers 21, 22 and the pressure chambers 23, 24 are communicated with each other through communication passages 25, 26 formed through the partition walls 19, 20. The rear parts 17*b*, 18*b* are provided with check valves 27, 28 by which one end (open to the pressure chamber 23, 24) of the communication passages 25, 26 is closable. Thus, the check valves 27, 28 are arranged to allow a hydraulic fluid to flow in a direction from the reservoir chambers 21, 22 to the pressure chambers 23, 24. Additionally, the front parts 17*a*, 18*a* are integrally formed with thrusting portions 29, 30 which are so formed as to drivingly engage the arm sections 8, 9 of the arm 6 upon being moved forward or leftward as seen in FIG. 1. More specifically, each of the thrusting portions 29, 30 is formed with an inclined surface 29*a*, 30*a* which is in slidable contact with the tapered side edge faces 8*a*, 9*a* of the arm sections 8, 9 of the arm 6 as clearly shown in FIGS. 3 and 4. Each inclined surface 29*a*, 30*a* is formed such that the front parts 17*a*, 18*a* are gradually tapered in a direction from the rear end section (contacting with the rear part 17*b*, 18*b*) to the tip end or front end. Each plunger 17, 18 is biased toward the arm sections 8, 9 or leftward as seen in FIG. 1 under the action of a compression springs 31, 32 disposed in the pressure chambers 23, 24. The springs 31, 32 have a relatively small biasing force. Each reservoir chamber 21, 22 is supplied with the hydraulic fluid through a hydraulic circuit 33 in which the fluid flow direction is selectively changeable by a change-over mechanism 34.

The hydraulic circuit 33 includes a hydraulic fluid or oil pump (or hydraulic pressure source) 61 for pressurizing the hydraulic fluid and discharging it into to a fluid main gallery 35. A main fluid passage 33*a* branches off from the main gallery 35 and is formed continuously through the cylinder head (not shown), another camshaft bearing (not shown), the camshaft 2 and the installation bolt 5. The main fluid passage 33*a* has an upstream part extending axially and is divided into two downstream parts which branch off radially and extends in the opposite directions. The downstream parts of the main fluid passage 33*a* are connected with an annular fluid passage 33*b* formed between the outer peripheral surface of a cylindrical section (no numeral) of the installation bolt 5 and the inner peripheral surface of the sleeve 4. A pair of fluid passages 38, 39 branch off from a downstream side of the annular fluid passage 33*b* and extend radially in the opposite directions. The branched fluid passages 38, 39 are respectively connected at their downstream end with the reservoir chambers 21, 22 through fluid or oil holes 36, 37 formed through the walls of the plunger rear parts 17*b*, 18*b*. Additionally, check valves 40, 41 are provided respectively in the branched fluid passages 38, 39 to allow the hydraulic fluid to flow only in the direction of the reservoir chamber 21, 22 as shown in FIG. 2. An orifice 42 is provided in the upstream side of the main fluid passage 33*a* to regulate a fluid pressure at a predetermined value.

As shown in FIGS. 3 and 4, the change-over mechanism 34 includes fluid drain passages 43, 44 which are respectively connected at their upstream ends 43*a*, 44*a* with the bottom portions of the pressure chambers 23, 24. In turn, the fluid drain passages 43, 44 are respectively connected at their downstream ends with generally cylindrical valve bores 45, 46 which are respectively formed generally parallel with the cylindrical bores 45, 46. Valve members 47, 48 are respectively slidably movably disposed in the valve bores 45, 46 to function to open or close the drain passages 43, 44. Each valve member 47, 48 is generally cylindrical and cup-shaped having a bottom wall, and formed in its cylindrical side wall with through-holes 47*a*, 48*a* which extend radially and located at the intermediate part in the axial direction thereof. The downstream ends 43*b*, 44*b* of each of the drain passages 43, 44 is connectable with the interior of the valve members 47, 48 through the through-holes 47*a*, 48*a*. Each valve of the members 47, 48 are contactable at their open ends with annular retainers 52, 52 which are supported by stopper rings 51, 51 fixed to the bore wall surfaces of the valve bores 45, 46. Compression coil springs 53, 54 are disposed between the bottom walls of the valve members 47 and the retainers 52 to bias the valve members 47, 48 upward as seen in FIGS. 3 and 4. Viz., in the direction to close the downstream end of the drain passage 43. The interiors of the valve members 47, 48 are communicated through drain holes 52*a*, 52*a* in the retainers 52, with the exterior of the valve timing control system V.

As shown in FIG. 1, two hydraulic pressure passages 49, 50 forming part of the change-over mechanism 34, are formed generally parallel with each other in the cylinder head, the cam bearing 3, the camshaft 2 and the sleeve 4. Each pressure passage 49, 50 is connected at its upstream end with the fluid main gallery 35 and at its downstream end with a pressure receiving chambers 55, 56 defined between the inner walls of the valve bores 45, 46 and the bottom wall (located at upside in FIGS. 3 and 4) of the valve members 47, 48. A four-way electromagnetic valve 60 is disposed in the upstream ends of the pressure passages 49, 50 and arranged to change the fluid flow directions among the pressure passages 49, 50, the main gallery 35 and drain passages 58, 59. The electromagnetic valve 60 selectively takes one of two positions P1, P2. In the position P1, the pressure passage 49 is connected with the main gallery 35, while the pressure passage 50 is connected with the drain passage 58. In position P2, the pressure passage 49 is connected with the drain passage 59, while the pressure passage 50 is connected with the main gallery 35.

An electronic controller 57 is electrically connected with the electromagnetic valve 60 and includes a microcomputer (not shown). The electronic controller 57 is arranged to detect the present engine operating conditions in accordance with a variety of information signals representing an engine speed, an intake air amount, a throttle opening degree (throttle valve position), and an engine coolant temperature. The engine speed, intake air amount, throttle opening degree and engine coolant temperature are respectively detected by a crank angle sensor, an air flow meter, a throttle opening sensor and an engine coolant temperature sensor (not shown). The electronic controller 57 is further arranged to generate a control signal in accordance with the change in engine operating conditions.

The manner of operation of the valve timing control system V will be discussed.

First, when the engine is started, the hydraulic pump 61 is simultaneously operated to supply hydraulic fluid under pressure to the hydraulic fluid main gallery 35. Then, the hydraulic fluid flows through the main fluid passage 33*a* and the orifice 42 and reaches the annular fluid passage 33*b*. The hydraulic fluid in the annular fluid passage 33*b* is distributed into the branched fluid passages 38, 39 and flows in the reservoir chambers 21, 22 of the plungers 17, 18 through fluid holes 36, 37. Then, in each of the plungers 17, 18, the hydraulic fluid opens the check valves 27, 28 and flows into the fluid pressure chambers 23, 24.

Under low engine load operating conditions a control signal representing such a state is output from the electronic controller 57 to the four-way electromagnetic valve 60. Accordingly, the electromagnetic valve 60 assumes position P1 as shown in FIG. 1 so that the hydraulic pressure passage 49 is connected with the main gallery 35 while the hydraulic pressure passage 50 is connected with the drain passage 58. The hydraulic fluid in the pressure passage 49 flows into the pressure receiving chamber 55 so that the pressure within the chamber 55 rises and pushes the valve member 47 against the bias of the coil spring 53. Accordingly, the through-hole 47*a* of the valve member 47 is brought into agreement with the drain passage 43 as shown in FIG. 3, so that the hydraulic fluid or pressure in the hydraulic pressure chamber 23 is smoothly discharged through the drain passage 43, the through-hole 47*a* and the inside space of the valve member 47 and the drain hole 52*a* of the retainer 52, and so that the pressure within the hydraulic pressure chamber 23 is lowered. As a result, the plunger 17 does not advance or move leftward in FIG. 1 and therefore the inclined surface 29*a* of the thrusting portion 29 of the plunger 17 is in a state wherein it merely contacts the side edge face 8*a* of the arm section 8 of the arm 6 under the small biasing force of the compression spring 31.

The hydraulic fluid or pressure in the pressure receiving chamber 56 is drained through the hydraulic pressure chamber 50 from the drain passage 58, so that the pressure within the pressure receiving chamber 56 is lowered. As a result, the valve member 48 is moved in the direction to decrease the volume of the pressure receiving chamber 56 under the bias of the coil spring 54 thereby closing the downstream end 44*b* of the drain passage 44. Accordingly, the hydraulic pressure in chamber 24 is raised under the action of the hydraulic fluid flowing from the reservoir chamber 22 to the hydraulic pressure chamber 24 through the check valve 28. The whole plunger 18 smoothly advances leftward in FIG. 1 under the combined forces of a high hydraulic pressure and the compression spring 32. The side end face 9*a* of the arm section 9 of the arm 6 is pushed rightward in FIG. 4 upon slidably contacting with the inclined surface 30*a* of the thrusting portion 30 of the plunger 18. As a result, the arm 6 is forced counterclockwise in FIG. 2 or the opposite direction of a rotational direction (indicated by an arrow R in FIG. 2) of the driven sprocket 1 so that the camshaft 2 is fully rotated counterclockwise or in negative direction relative to the driven sprocket 1. In this situation, the plunger 18 seems to be pushed back under the reaction force due to the clockwise rotational force of the driven sprocket 1; however, the plunger 18 is prevented from its backward movement by virtue of the above-mentioned combined forces. This prevents the camshaft 2 from making its clockwise relative movement, thereby maintaining the camshaft 2 at a position to retard the closing timing of the intake valve of the engine.

When the engine operation is shifted to a high engine load condition, the electronic controller 57 outputs the control signal in accordance with the engine operating conditions to the four-way electromagnetic valve 60. The electromagnetic valve 60 is changed in operation to assume position P2, so that the hydraulic pressure passage 50 is connected with the main gallery 35 while the hydraulic pressure passage 49 is connected with the drain passage 59. Accordingly, the hydraulic fluid in the pressure passage 50 flows into the pressure receiving chamber 56 thereby pushing the valve member 48 downward as seen in FIG. 4 against the bias of the coil spring 54. The through-hole 48*a* of the valve member 48 is brought into agreement with the drain passage 44, so that the hydraulic fluid in the hydraulic pressure chamber 24 is drained and therefore lowered in pressure. As a result, the whole plunger 18 moves backward or rightward in FIG. 1, so that the inclined surface 30*a* of the thrusting portion 30 of the plunger 18 merely contacts the side edge face 9*a* of the arm section 9 of the arm 6 under the small biasing force of the compression spring 32.

At this time, the hydraulic pressure in the pressure receiving chamber 55 is drained through the hydraulic pressure passage 49 from the drain passage 59, so that the pressure in the pressure receiving chamber 55 is lowered. Accordingly, the valve member 47 moves upward as seen in FIG. 3 thereby closing the downstream end of the drain passage 43. Consequently, the pressure within the hydraulic pressure chamber 23 rises, so that the whole plunger 17 smoothly advances leftward in FIG. 1 under the combined forces of the high hydraulic pressure and the compression spring 31. Accordingly, the inclined surface 29*a* of the thrusting portion 29 of the plunger 17 pushes the side edge face 8*a* of the arm section 8 of the arm 6 clockwise in FIG. 2 or in the same direction as the rotational direction (indicated by the arrow R) of the driven sprocket 1. As a result, the camshaft 2 fully rotates clockwise or a positive direction relative to the driven sprocket and therefore is maintained at a position to advance the closing timing of the intake valve of the engine.

Thus, in the above embodiment, the hydraulic pressure in the hydraulic pressure chambers 23, 24 is controlled by the change-over mechanism 34 thereby to change the relative axial movement of the plungers 17, 18 so as to rotationally move the arm 6 in positive and negative directions respectively. Accordingly, the relative rotational movement of the camshaft 2 in the positive and negative directions can be smoothly changed in accordance with a change in engine operating condition. In particular, the advancing movement of each plunger 17, 18 is carried out by supplying the hydraulic pressure to the hydraulic fluid chambers 23, 24 from the reservoir chambers 21, 22 immediately when a rotational torque change in the positive or negative direction is generated in the camshaft 2. That is to say, the arm sections 8, 9 of the arm 6 separates from the thrusting portions 29, 30 of the plungers 17, 18. This improves the control response while enabling the plungers 17, 18 to advance in response to a small amount of the hydraulic fluid. Additionally, by virtue of each of the check valves 27, 28, the hydraulic fluid which has been applied from the reservoir chambers 20, 22 into the pressure chambers 23, 24, can be prevented from reverse flow, thereby securely preventing the withdrawal or backward movement of each plunger 17, 18 due to a rotational torque change in the camshaft 2 in the positive or negative direction. This further improves the response in control while enabling the camshaft 2 to be maintained at the position at which the maximum relative rotation of the camshaft 2 is made with respect to the driven sprocket 1. Furthermore, by virtue of the check valves 40, 41 and the reservoir chambers 20, 22 at the upstream side of the hydraulic pressure chambers 23, 24, the hydraulic fluid can be retained in the reservoir chambers 20, 22 even when the engine is stopped. Accordingly, it becomes possible to supply the hydraulic fluid to the hydraulic pressure chambers 23, 24 during an engine starting while suppressing free axial movement of each plunger 17, 18 thereby preventing the generation of striking noise due to the interference between the plungers 17, 18 and the arm 6 and the like. Moreover, the valve members 47, 48 are parallely arranged with the respective plungers 17, 18 within (not outside) the driven sprocket main body 12. Therefore, the whole valve timing control system V can be made compact.

While there has been described a preferred form of the invention, modifications and variations are possible in light of the above teachings. It is therefore to be understood that, within the scope of the claims, the invention may be practiced otherwise than as specifically described. In this regard, the present invention may be applicable to exhaust valves or to both the intake and exhaust valves.

What is claimed is:

1. A valve timing control system of an internal combustion engine, comprising:

a generally cylindrical rotatable member movably connected to an end section of a camshaft, said rotatable member being drivably connected with a crankshaft of the engine;

an arm fixedly connected to the end section of said camshaft and extending generally diametrically of said rotatable member;

first and second plungers slidably movably disposed in and extending along an axial direction of said rotatable member, each of said first and second plungers defining a hydraulic pressure chamber and being projectable toward said arm upon supply of a hydraulic pressure to said hydraulic pressure chamber, each of said first and second plungers having a thrusting portion, said thrusting portion having an inclined surface adapted to cause said arm to circumferentially rotationally move relative to said rotatable member upon projection of said plunger, the hydraulic pressure being supplied to said hydraulic pressure chamber through a check valve; and change-over means for changing over the supply of the hydraulic pressure to said pressure chambers of said first and second plungers in accordance with an engine operating condition.

2. A valve timing control system of an internal combustion engine, comprising:

a generally cylindrical rotatable member coaxially and movably connected to one end section of a camshaft, said rotatable member being drivably connected to a crankshaft of the engine;

an arm fixedly connected to the one end section of said camshaft and extending generally diametrically of said rotatable member, said arm including first and second arm sections which extend generally radially outwardly and generally in opposite directions to each other;

first and second plungers slidably movably disposed and extending along an axial direction of said rotatable member, each of said first and second plunger being projectable toward said arm and having a thrusting portion, said thrusting portion having an inclined surface adapted to contact with and push each of said first and second arm sections so that said arm makes its circumferentially rotational movement around an axis of the camshaft relative to said rotatable member upon projection of said plunger, said first and second plungers being located to cause said arm to make the rotational movement in opposite directions, respectively, upon projection of said first and second plungers;

first and second hydraulic pressure chambers to be supplied with a hydraulic pressure, at least a part of said first hydraulic chamber being defined by said first plunger so that said first plunger projects toward said first arm section of said arm upon supply of said hydraulic pressure to said first hydraulic pressure chamber, at least a part of said second hydraulic pressure chamber being defined by said second plungers so that said second plunger projects toward said second arm section of said arm upon supply of the hydraulic pressure to said second hydraulic pressure chamber;

first and second check valves through which the hydraulic pressure is supplied to said respective first and second hydraulic pressure chambers; and change-over means for changing over the supply of the hydraulic pressure to said first and second hydraulic pressure chambers in accordance with an engine operating condition.

3. A valve timing control system as claimed in claim 2, wherein said change-over means includes means for selectively supplying the hydraulic pressure to one of said first and second hydraulic pressure chambers in accordance with the engine operating condition.

4. A valve timing control system as claimed in claim 2, further comprising a generally cylindrical sleeve coaxially and fixedly connected to the end section of the camshaft, said rotatable member being slidably movably mounted on said sleeve, said arm being fixedly secured to said sleeve.

5. A valve timing control system as claimed in claim 4, wherein said rotatable member is formed with first and second cylindrical bores extending along the axial direction of said rotatable member, said first and second plungers being slidably movably disposed respectively in said first and second cylindrical bores, said first and second hydraulic pressure chambers being defined respectively in said first and second cylindrical bores.

6. A valve timing control system as claimed in claim 5, wherein said first and second plungers are respectively formed therein with hydraulic fluid reservoir chambers which are respectively connectable through said first and second check valves with said first and second hydraulic pressure chambers, said first and second reservoir chambers being connected with a hydraulic pressure source.

7. A valve timing control system as claimed in claim 2, wherein said change-over means includes first and second pressure releasing means respectively for allowing the hydraulic pressures in said first and second hydraulic pressure chambers to release upon being actuated, and control means for selectively actuating said first and second pressure releasing means in accordance with the engine operating condition.

* * * * *